US008680781B1

(12) United States Patent
Pflaum

(10) Patent No.: US 8,680,781 B1
(45) Date of Patent: Mar. 25, 2014

(54) CIRCUIT AND METHOD FOR DRIVING LEDS

(75) Inventor: Bernd Pflaum, Unterhaching (DE)

(73) Assignee: Infineon Technologies Austria AG, Villach (AT)

( * ) Notice: Subject to any disclaimer, the term of this patent is extended or adjusted under 35 U.S.C. 154(b) by 5 days.

(21) Appl. No.: 13/607,246

(22) Filed: Sep. 7, 2012

(51) Int. Cl.
*H05B 37/02* (2006.01)
*G05F 3/02* (2006.01)

(52) U.S. Cl.
USPC ..... 315/291; 315/307

(58) Field of Classification Search
None
See application file for complete search history.

(56) References Cited

U.S. PATENT DOCUMENTS

| | | | | |
|---|---|---|---|---|
| 6,002,214 | A * | 12/1999 | Ribarich | 315/307 |
| 6,326,740 | B1 * | 12/2001 | Chang et al. | 315/291 |
| 7,952,301 | B2 * | 5/2011 | Biegel | 315/291 |
| 2005/0035729 | A1 * | 2/2005 | Lev et al. | 315/291 |
| 2005/0110431 | A1 * | 5/2005 | Ben-Yaakov | 315/291 |
| 2005/0218838 | A1 * | 10/2005 | Lys | 315/291 |
| 2005/0231133 | A1 * | 10/2005 | Lys | 315/291 |
| 2008/0129222 | A1 * | 6/2008 | Chen et al. | 315/294 |
| 2008/0211426 | A1 * | 9/2008 | Kuo et al. | 315/282 |
| 2011/0057578 | A1 * | 3/2011 | Otake et al. | 315/291 |
| 2011/0115403 | A1 * | 5/2011 | De Smit | 315/291 |
| 2012/0133295 | A1 | 5/2012 | Pereira et al. | |

FOREIGN PATENT DOCUMENTS

| | | | |
|---|---|---|---|
| DE | DE 10 2009 017 139 | A | 10/2010 |
| WO | WO 01/03474 | A1 | 1/2001 |

OTHER PUBLICATIONS

Curtis, K., "Buck Configuration High-Power LED Driver," Microchip Technology, Inc., Application Note, AN874, DS00874C, 2006, 16 pages.

* cited by examiner

*Primary Examiner* — Crystal L Hammond
(74) *Attorney, Agent, or Firm* — Slater & Matsil, L.L.P.

(57) ABSTRACT

A circuit for driving light emitting diodes (LEDs) includes a first semiconductor switch and a freewheeling device coupled between a first supply terminal that provides a supply voltage and a second supply terminal that provides a reference potential. The first semiconductor switch is responsive to a driver signal. An LED and an inductor are coupled in series between a common circuit node of the first semiconductor switch and the freewheeling device and either the first supply terminal or the second supply terminal. A current measurement circuit is coupled to the LED and provides a load current signal which represents a load current passing through the at least one LED. A first feedback circuit includes an on-off controller that receives load current signal and a reference signal.

15 Claims, 11 Drawing Sheets

CIRCUIT AND METHOD FOR DRIVING LEDS

TECHNICAL FIELD

The present description relates to circuits and methods for driving light emitting diodes (LEDs), particularly to circuits and methods for driving LEDs with a load current that is regulated to keep the resulting perceivable brightness of the LEDs at a desired value.

BACKGROUND

Light emitting diodes have emerged in recent years as viable sources of light. Light emitting diodes, also called solid-state lighting devices or simply LEDs, are highly efficient, durable and long lasting lighting devices. The technology has improved enormously since the 1960s when the first LEDs came to market. LEDs are now the industry standard in a variety of specialty lighting markets and the popular bulbs are rapidly entering the general illumination market. LED bulbs are more energy efficient and last longer than, for example, incandescent, halogen and fluorescent bulbs. Advances in technology have provided LEDs that are typically four to five times more efficient than incandescent bulbs and have lifetimes exceeding tens of thousands of hours.

LEDs are current-driven devices, whose brightness is proportional to their average forward current (also referred to as their average load current). For this reason LEDs are usually driven using a current source that provides a constant current. The constant-current source eliminates load current variations resulting from variations in the forward voltage of a LED and thus ensures a constant LED brightness. In known LED drivers, which are often implemented as switching converters such as buck, boost, or buck-boost converters, a plurality of components are integrated that evaluate voltages and compare those voltages to a reference voltage. Usually a power semiconductor switch (e.g., a MOSFET) is switched on and off in accordance with the results of this comparison, in order to charge or discharge an inductor.

The application note AN874, "Buck Configuration High-Power LED Driver," Microchip Technology, 2006, describes a switching power supply circuit that controls the load current supplied to an LED. However, during the delay time period that is needed to perform the measurements of the LED current and to activate the switch (e.g., due to propagation delays), in order to charge or discharge the inductor, the desired maximum value of the LED current is exceeded. This results in a mismatch between the desired average load current and the actual average load current supplied to the LED, which results in an undesired increase of brightness of the LEDs.

Although this mismatch may be considered during circuit design, the average load current supplied to the LED and thus the LED brightness itself will be different for different forward voltages (which are temperature-dependent) of the LED as well as for a different number of LEDs connected in series and for different supply voltages applied to the LED and the LED driver. That is, common LED drivers—even when designed as current sources—are usually not able to keep the average load current constant (e.g., while the supply voltage or the LED forward voltages are varying for different inductance values of the inductor) due to the delay time periods mentioned above. Thus, the LED drivers have to be reconfigured for each different situation.

A cost-efficient, but effective solution is needed that ensures (an almost) constant brightness for different supply voltages or different LED forward voltages without the need of reconfiguring the circuit.

SUMMARY OF THE INVENTION

A circuit for driving light emitting diodes (LEDs) is described. In accordance with one example of the present invention the circuit includes a first semiconductor switch and a freewheeling device coupled in series between a first supply terminal that provides a supply voltage and a second supply terminal that provides a reference potential, wherein the first semiconductor switch is responsive to a driver signal. At least one LED and an inductor are coupled in series between a common circuit node of the first semiconductor switch and the freewheeling device and either the first supply terminal or the second supply terminal. A current measurement circuit is coupled to the LED and provides a load current signal, which represents a load current passing through the at least one LED. A first feedback circuit includes an on-off controller that receives the load current signal and a reference signal, compares the load current signal with the reference signal, and generates the driver signal dependent on the comparison. Furthermore, a second feedback circuit receives the load current signal, determines an average load current signal and generates the reference signal supplied to the first feedback circuit dependent on the average load current signal and a reference value.

In accordance with another example of the invention the circuit includes a first semiconductor switch and a freewheeling device coupled in series between a first supply terminal that provides a supply voltage and a second supply terminal that provides a reference potential, wherein the first semiconductor switch is responsive to a driver signal. At least one LED and an inductor are coupled in series between a common circuit node of the first semiconductor switch and the freewheeling device and either the first supply terminal or the second supply terminal. A current measurement circuit is coupled to the LED and provides a load current signal, which represents a load current passing through the at least one LED. A first feedback circuit includes an on-off controller that receives the load current signal and a reference signal, compares the load current signal with the reference signal, and generates the driver signal dependent on the comparison. Furthermore, a second feedback circuit is provided. The second feedback circuit includes a filter that receives the load current signal and provides a filtered signal representing the average load current. Furthermore, the second feedback circuit includes a regulator that receives the filtered signal and, as set point value, a reference value, determines a control signal dependent on the difference between the reference value and the filtered signal in accordance with a predefined control law, and generates the reference signal in accordance with the control signal.

Furthermore, a LED driver for driving at least one LED is described. The LED driver may be coupled in series to an inductor between a driver output terminal and a first or a second supply terminal providing a supply voltage and a reference potential, respectively. According to one example of the invention, the LED driver includes a first semiconductor switch and a freewheeling device coupled in series between the first supply terminal, which provides the supply voltage, and the second supply terminal, which provides the reference potential. The first semiconductor switch is responsive to a driver signal. Furthermore, the common circuit node of the first semiconductor switch and the freewheeling device is connected to the output terminal. The LED driver further includes a current measurement circuit that is coupled to the LED and provides a load current signal which represents a load current passing through the at least one LED. A first feedback circuit includes an on-off controller that receives load current signal and a reference signal, compares the load current signal with the reference signal, and generates the driver signal dependent on the comparison. A second feedback circuit comprises a filter and a regulator, wherein the filter receives the load current signal and provides a filtered signal that represents the average load current. The regulator receives the filtered signal and, as set point value, a reference value, determines a control signal dependent on the difference between the reference value and the filtered signal in accordance with a predefined control law, and generates the reference signal in accordance with the control signal.

Still further a method for driving a at least one LED is described. The at least one LED is coupled in series to an inductor between an output terminal and a first or a second supply terminal providing a supply voltage and a reference potential, respectively. In accordance with one example of the invention, the method comprises: measuring a load current passing through the at least one LED, thus generating a load current signal which represents the load current; alternately applying either the supply voltage or the reference potential to the output terminal in accordance with a driver signal; comparing the load current signal with a reference signal and generating the driver signal dependent on the comparison; and determining an average load current signal, from the load current signal; generating the reference signal dependent on the average load current signal and a reference value.

BRIEF DESCRIPTION OF THE DRAWINGS

The invention can be better understood with reference to the following drawings and descriptions. The components in the figures are not necessarily to scale, instead emphasis is placed upon illustrating the principles of the invention. Moreover, in the figures, like reference numerals designate corresponding parts. In the drawings.

DETAILED DESCRIPTION OF ILLUSTRATIVE EMBODIMENTS

In the following detailed description, reference is made to the accompanying drawings, which form a part thereof, and in which are shown by way of illustration specific examples of how the invention may be practiced. In this regard, directional terminology, such as "top," "bottom," "front," "back," "leading," "trailing" etc., is used with reference to the orientation of the figures being described. Because components of exemplary embodiments can be positioned in a number of different orientations, the directional terminology is used for purposes of illustration and is in no way limiting. It is to be understood that other examples may be utilized and structural or logical changes may be made without departing from the scope of the present invention. The following detailed description, therefore, is not to be taken in a limiting sense, and the scope of the present invention is defined by the appended claims. It is to be understood that the features of the various exemplary embodiments described herein may be combined with each other, unless specifically noted otherwise.

Figure 1:
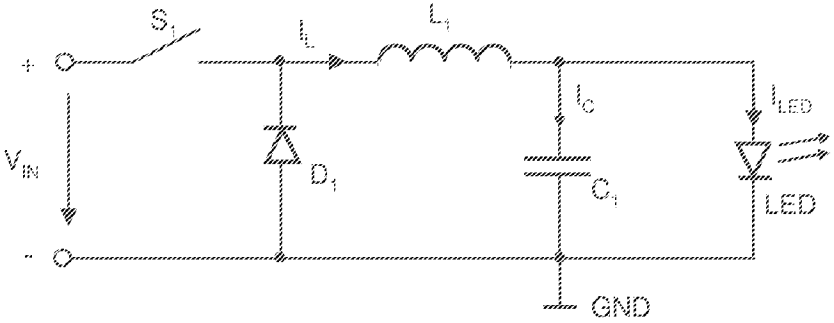
FIG. 1 illustrates an LED driver circuit in buck topology.

FIG. 1 illustrates a LED driver which includes a buck converter. In this driver circuit, a switch $S_1$ is coupled between a first supply terminal providing a supply voltage $V_{IN}$ and a first terminal of an inductor $L_1$. A diode $D_1$ is coupled between the common circuit node of the switch $S_1$ and the inductor $L_1$ and a second supply terminal, at which a reference potential GND is provided. The anode of the diode $D_1$ is thereby connected to the second supply terminal. An output capacitor $C_1$ is coupled between a second terminal of the inductor $L_1$ and the second supply terminal, at which the reference potential GND is provided. A load, which is an LED or a series circuit of several LEDs (also referred to as "LED chain"), is coupled in parallel to the capacitor $C_1$.

The buck converter is a voltage regulator that translates a high supply voltage $V_{IN}$ into a lower output voltage. This is accomplished by rapidly switching the inductor/capacitor (LC) network between the supply voltage and ground such that alternately either the supply voltage $V_{IN}$ or the reference potential (ground) GND is applied to the LC network. While the switch $S_1$ is closed, the inductor $L_1$ is connected to the input voltage $V_{IN}$, the LC circuit is in its "charging state," and an increasing inductor current flow $I_L$ passes from the first supply terminal (at which the input voltage $V_{IN}$ is applied) through the inductor $L_1$ to the parallel circuit composed of the output capacitor $C_1$ and the LED(s).

Figure 2:
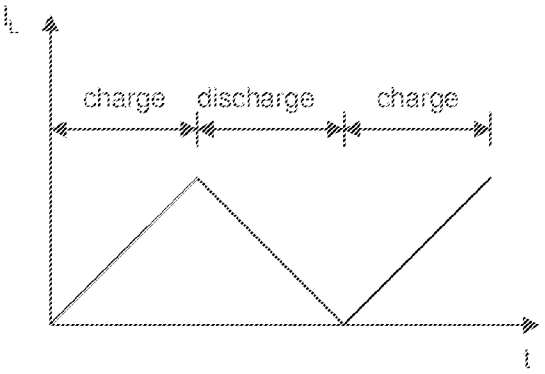
FIG. 2 illustrates characteristics of currents within the circuit of FIG. 1.
Figure 2:
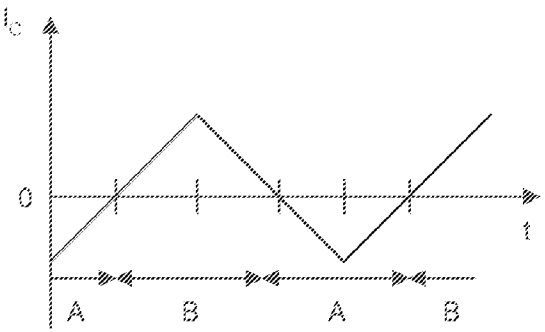

While the charging current $I_L$ is flowing through the inductor $L_1$ to the LED(s), part of its energy is stored in the inductor $L_1$ as a magnetic field. When the switch $S_1$ is (re)opened, the circuit enters its "discharge state" and the magnetic field of the inductor $L_1$ collapses, while the current flow to the LED(s) continues. When the inductor current $I_L$ drops to zero, the switch $S_1$ is closed again and the charge/discharge cycle starts over. The result of this switching cycle is an inductor current $I_L$ that ramps up and down over the course of a cycle, as shown in FIG. 2.

The capacitor $C_1$ in the LC network acts to smooth the inductor current $I_L$ into a DC current flow to the LED(s). When the inductor current $I_L$ is greater than the load current $I_{LED}$, the load current $I_{LED}$ is supplied by the inductor current $I_L$ and any surplus current $I_c$ flows into the capacitor $C_1$, thereby charging it. In FIG. 2 this is shown as phase B in the timing diagram illustrating the capacitor current $I_C$ over time. When the inductor current $I_L$ falls below the load current requirement, the current flow $I_C$ through the capacitor $C_1$ reverses and the capacitor current $I_C$ supplements the inductor current $I_L$ to make up the difference between the inductor current $I_L$ and the required load current $I_{LED}$. In FIG. 2 this is shown as phase A in the timing diagram illustrating the capacitor current $I_C$.

A feedback circuit is usually implemented to regulate the output current (i.e., the load current $i_{LED}$) supplied to the load by the switching converter. Such a feedback circuit monitors the load current $I_{LED}$ and compares it to a stable reference. Based on the result of the comparison, the circuit adjusts the duty cycle of the switching operation to compensate for any discrepancies. The feedback circuit compensates for any variations of the load voltage resulting from component or timing tolerances and it adjusts the duty cycle to compensate for changes in the input voltage $V_{IN}$ to keep the load current $I_{LED}$ at its desired level.

One switching power supply design concept is the idea of distinguishing between continuous versus discontinuous inductor current $I_L$. In one mode of operation, which is usually referred to as "discontinuous current mode" (short: DCM), the inductor current $I_L$ drops to zero at the end of each discharge cycle as described above and remains zero for a finite time period. However, in another mode of operation, which is usually referred to as "continuous current mode" (short: CCM), the inductor current $I_L$ does not drop to zero. Instead, the inductor $L_1$ maintains a DC current component throughout the switching cycle.

The resulting inductor current $I_L$ has both AC and DC components to its waveform. The DC component equals the average current flow $I_{AVG}$ during the switching cycle and is determined by a reference voltage $V_{DRIVE}$. The AC component is a triangular shaped waveform superimposed on the DC component $I_{AVG}$ and is caused by the switching action of the driver circuit (i.e., the switching converter). The advantage of a CCM operation is that the inductor current $I_L$ flows to the output continuously, which reduces the charge storing requirements on the capacitor $C_1$.

Figure 3:
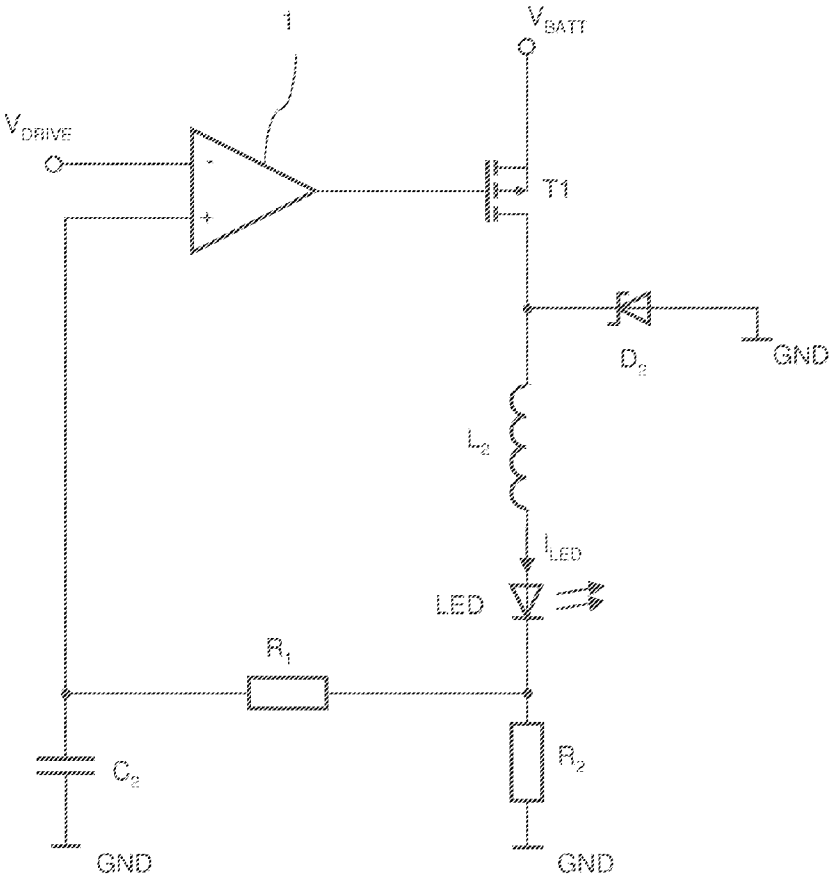
FIG. 3 illustrates an LED current control circuit in buck configuration.

The driver circuit shown in FIG. 3 takes advantage of the DC component $I_{AVG}$ of the inductor current $I_L$ in a switching converter operating in CCM. A switching transistor $T_1$, an inductor $L_2$, a LED (which may also be regarded as representing a LED chain) and a current measurement resistor $R_2$ (shunt resistor) are coupled in series between a first supply terminal, which provides the supply potential $V_{BATT}$, and a second supply terminal, which provides a reference potential GND (e.g., ground). The load current-path (e.g., drain-source current-path in case of a MOSFET) of transistor $T_1$ is coupled between the first supply terminal for supply potential $V_{BATT}$ and the inductor $L_2$. The inductor $L_2$ is coupled between the load current-path of the transistor $T_1$ and the LED. The LED is coupled to the inductance $L_2$ with its anode. The current measurement resistor $R_2$ is coupled between the cathode of the LED and the second supply terminal for reference potential GND.

A diode $D_2$, which may be a Schottky diode, is coupled between the common circuit node of the transistor $T_1$ and the inductor $L_2$ and the second supply (GND). It should be noted that the diode $D_2$ operates as a freewheeling diode and may be replaced by a second transistor (e.g., a MOSFET). In this case the two transistors would form a transistor half-bridge. A resistor $R_1$ is coupled between the common circuit node of the LED and the current measurement resistor $R_2$ and a first (non-inverting) input terminal of a comparator 1. A further capacitor $C_2$ is coupled between the common circuit node of the comparator 1 and the resistor $R_1$ and the second supply terminal (GND). The output of comparator 1 is coupled to the control terminal (i.e., the gate terminal in case of a MOSFET) of the transistor $T_1$. At its second (inverting) input terminal, the comparator 1 receives the reference voltage $V_{DRIVE}$.

When analysing the circuit of FIG. 3 one can see that the capacitor $C_2$ and the resistor $R_1$ form an RC low-pass filter. This filter receives, at its input, a voltage signal $i_L \cdot R_2$ (i.e., the voltage drop across the current measurement resistor $R_2$), which is proportional to the inductor current $i_L$, and provides, as an output signal, a voltage $V_{AVG}$ which represents the average inductor current $I_{AVG}$. The comparator 1 thus essentially compares a signal representing the average inductor current with a corresponding reference signal. The comparator 1 may have a hysteresis. That is, the comparator 1 triggers a switch-off of the transistor $T_1$ when the average inductor current rises above a first threshold and triggers a switch-on of the transistor $T_1$ when the average inductor current falls below a second threshold which is lower than the first threshold. In this regard the comparator 1 operates as a bang-bang controller (on-off controller).

Apart from the feedback circuit (including resistor $R_1$, capacitor $C_2$, comparator 1) and the current measurement resistor $R_2$, the circuit of FIG. 3 is essentially the same as the previous example illustrated in FIG. 1. However, the output capacitor $C_1$ (see FIG. 1) is not required in the example of FIG. 3. The buck converter circuit illustrated in FIG. 3 thus has a similar charge/discharge cycle as the buck converter of FIG. 1. The charging state of the switching cycle is initiated by switching on the transistor $T_1$. This results in an increasing current flow from the supply terminal ($V_{BATT}$) through the transistor $T_1$, the inductor $L_2$, the LED and the shunt resistor $R_2$. When the voltage across the capacitor $C_2$ (which represents the average inductor current) exceeds the reference voltage $V_{DRIVE}$ supplied to the comparator 1, then the comparator 1 switches off the transistor $T_1$ thus initiating the discharge state of the circuit.

Figure 4:
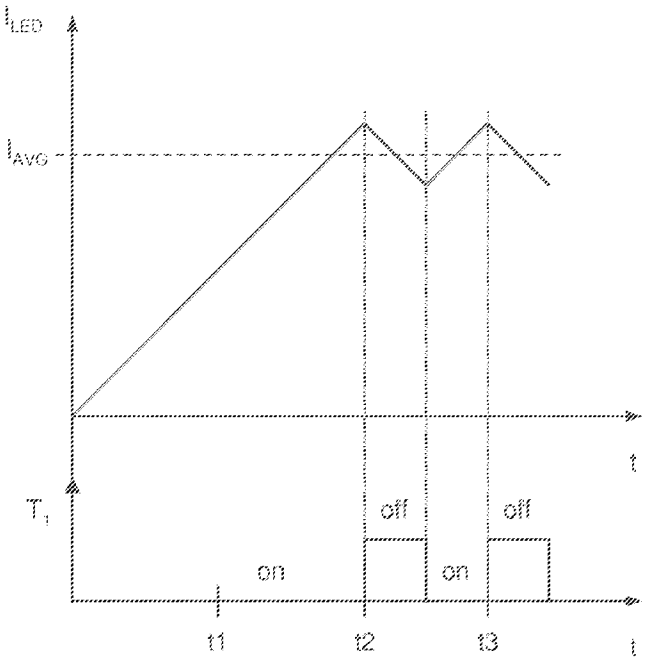
FIG. 4 is a illustrates the characteristics of the LED current and the switching state of a switch within the circuit of FIG. 3.

In the discharge state, current flows through the freewheeling diode $D_2$, the inductor $L_2$ and the resistor $R_2$. The inductor current $I_L$ ramps down until the voltage across the capacitor $C_2$ (representing the average inductor current) drops below the reference voltage $V_{DRIVE}$. As a consequence, the transistor $T_1$ is switched on again and the next cycle begins. The resulting current flow $I_{LED}$ through the LED and the inductor is a DC level $I_{AVG}$ superposed with a small triangular AC "ripple" current that is synchronous to the charge/discharge cycle. This situation is shown in FIG. 4. The AC component of the current $I_{LED}$ around its mean value $I_{AVG}$ is common to all known switching regulators.

FIG. 4 shows the load current $I_{LED}$ through the LED (which is equal to the inductor current) and the resulting switching states of the transistor $T_1$. Although a feedback circuit, which regulates the average load current $I_{AVG}$, is provided, the load current $I_{LED}$ is still different for different supply voltages $V_{BATT}$, as well as for different inductances of the inductor $L_2$ and different forward voltages of the LED. This is mainly a result of the delay which elapses between a transition (e.g., from a low level to a high level or vice versa) in the comparator output signal and the actual switching operation of the transistor $T_1$. During this delay time period a transient overshot of the inductor current occurs. That is, the peak level of the AC component of the inductor current is higher than it would be if the delay was zero. The higher the voltage applied to the inductor, the higher the overshot for a given delay time. Similarly, the lower the inductance, the higher the overshot for a given delay time. As the delay times are not equal for activating and deactivating the transistor $T_1$, the overshot is higher for the upper peak of the inductor current and, as a result, the average value of the inductor current is different for different inductor values as well as for different supply voltages $V_{BATT}$. A varying average inductor current can be perceived as a varying brightness of the LED. That is, the brightness of the LED depends on the supply voltage in an undesired manner. The feedback circuit of the LED driver circuit of FIG. 3 is not able to compensate for this effect and thus a variation of the supply voltage $V_{BATT}$ entails a corresponding brightness variation. For the same reason, the brightness of the LED will not be constant for different inductance values of the inductor $L_2$ and for different forward voltages of the LED(s).

Figure 5A:
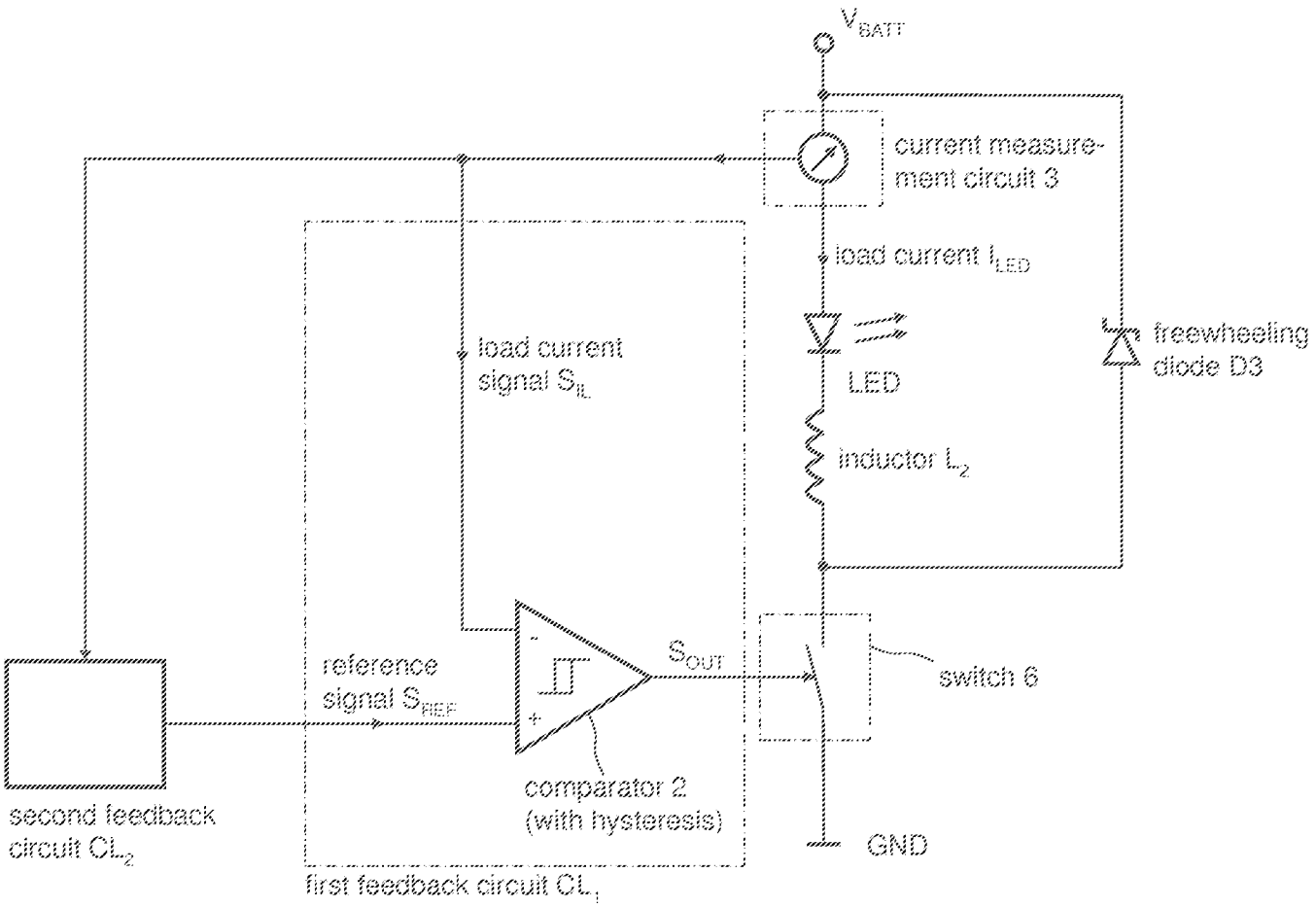
FIG. 5 is a illustrates three (FIGS. 5*a*, 5*b*, and 5*c*) different examples of a LED driver circuit.

FIG. 5 illustrates some exemplary circuits which are capable of compensating for the undesired effect mentioned above. FIG. 5*a* illustrates a first exemplary circuit that keeps the mean value $I_{AVG}$ of the LED current $I_{LED}$ constant or at least significantly reduces brightness variations resulting from variations of the supply voltage $V_{BATT}$.

The circuit of FIG. 5*a* is similar to the circuit of FIG. 3. However, the semiconductor switch 6 is a low-side switch, whereas the transistor $T_1$ is a high-side switch in the example of FIG. 3. In the present example the low-side switch 6 is connected in series to the inductor $L_2$ and the LED (representing a single LED or a LED chain including any appropriate number of LEDs). The series circuit of switch 6, LED, and inductor $L_2$ is coupled between a first supply terminal that is provided with the supply voltage $V_{BATT}$ (e.g., the battery voltage of an automotive battery) and a second supply terminal which is at a reference potential GND (e.g., ground). The order of inductor $L_2$ and LED may be interchanged. A current measurement circuit 3 may be coupled to the series circuit (composed of switch 6, LED, and inductor $L_2$) such that it measures the load current $i_{LED}$ supplied to the LED. In the present configuration load current $i_{LED}$ and inductor current $i_L$ are equal. The current measurement circuit 3 generates a load current signal $S_{IL}$, which represents the load current $i_L$. Many appropriate current measurement circuits are known in the field and one exemplary current measurement circuit is explained later with reference to FIG. 5*c*. The semiconductor switch 6 can be switched on and off by applying an appropriate driver signal $S_{OUT}$ to a respective control signal of the switch 6. If a MOSFET is used as semiconductor switch, the driver signal $S_{OUT}$ may be a gate current or a gate voltage that is sufficient to activate (switch on) or deactivate (switch off) the switch 6.

The driver signal is generated by a comparator 2 (similar to the example of FIG. 3) which is supplied with the load current signal $S_{IL}$ and a reference signal $S_{REF}$. The comparator 2 has a hysteresis and generates a high-level output signal $S_{OUT}$ (for activating the switch 6) when the difference $S_{REF}-S_{IL}$ exceeds a first threshold. Analogously, it generates a low-level output signal $S_{OUT}$ (for deactivating the switch 6) when the difference $S_{REF}-S_{IL}$ falls below a second threshold. The two thresholds typically are equal in magnitude but have opposite signs. In an ideal case (without any propagation delays as discussed above) the actual load current $I_{LED}$ varies around an average current $I_{AVG}$ that corresponds to $V_{REF}$. The superposed AC component (also referred to as "ripple current") has a substantial triangular-shaped waveform and a peak-to-peak amplitude dependent on the hysteresis of the comparator 2. As elaborated above, the delay between a transition of the driver signal $S_{OUT}$ and the corresponding switching operation of the switch 6 may lead to a systematic error resulting in a positive deviation $\Delta i$ of the actual average load current $I_{AVG}=I_{REF}+\Delta I$, wherein $I_{REF}$ is the "ideal" average load current corresponding to the reference signal $S_{REF}$ and the deviation $\Delta I$ is dependent—inter alia—on the supply voltage $V_{BATT}$. Generally, the comparator 2 is part of a first feedback circuit $CL_1$, wherein the comparator 2, in essence, implements an on-off controller (also referred to as bang-bang-controller) to regulate the load current $i_L$. The reference signal is the reference input (set point value) for the on-off controller of the first feedback circuit $CL_1$.

To compensate for the adverse effect of the delay times discussed above, a second feedback circuit $CL_2$ (control loop) is provided. The second feedback circuit receives, as an input signal, the load current signal $S_{IL}$ and generates the reference signal $S_{REF}$ for the first feedback circuit $CL_1$. According to the control law implemented by the second feedback circuit $CL_2$ the reference signal $S_{REF}$ represents the difference between an average load current value $I_{AVG}$ and a pre-set constant value. One exemplary implementation of the second feedback circuit is discussed later with reference to FIG. 5*c*.

The operation of the second feedback circuit $CL_2$ and its effect can be summarized as follows. When the actual average $I_{AVG}$ of the load current $i_{LED}$ changes in response to a change of the supply voltage $V_{BATT}$ (due to the adverse effect of the delay times explained above) the second feedback loop $CL_2$ counteracts this change of the average load current $I_{AVG}$ by adjusting the reference signal $S_{REF}$ (i.e., the set point value) for the first feedback circuit. When the average load current begins to rise in response to a rising supply voltage $V_{BATT}$, the second feedback circuit $CL_2$ reduces the reference signal $S_{REF}$ (i.e., the set point value) supplied to the first feedback circuit $CL_1$) thus compensating for the effect of the rising supply voltage $V_{BATT}$. Similarly, the average load current $I_{AVG}$ and thus the brightness of the LED(s) will be kept constant for different inductance values of the inductor $L_2$ and for different forward voltages of the LED(s).

Figure 5B:
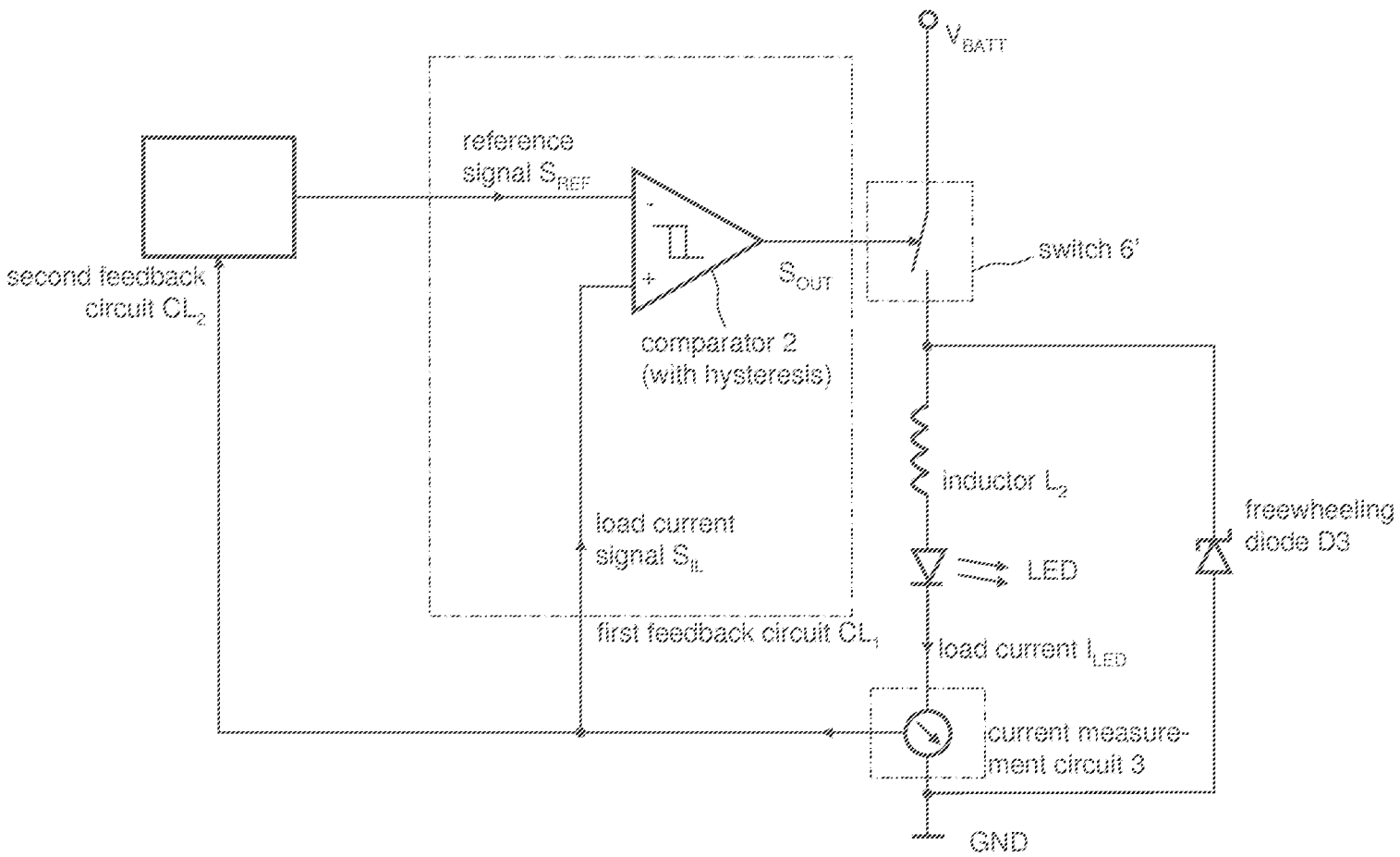

The example of FIG. 5*b* is almost identical to the circuit depicted in FIG. 5*a*. The only difference is that the power semiconductor switch 6 is a high-side switch instead of a low-side switch (as it is in FIG. 5*a*). In this case the current measurement may be accomplished at the low-side. The free-wheeling diode D3 is coupled between the common circuit node of the inductor $L_2$ and the switch 6 and the reference potential GND (and not to supply potential $V_{BATT}$ as in FIG. 5*a*). The operation of the LED driver circuit of FIG. 5*b* is the same as the operation of the LED driver circuit of FIG. 5*a*.

Figure 5C:
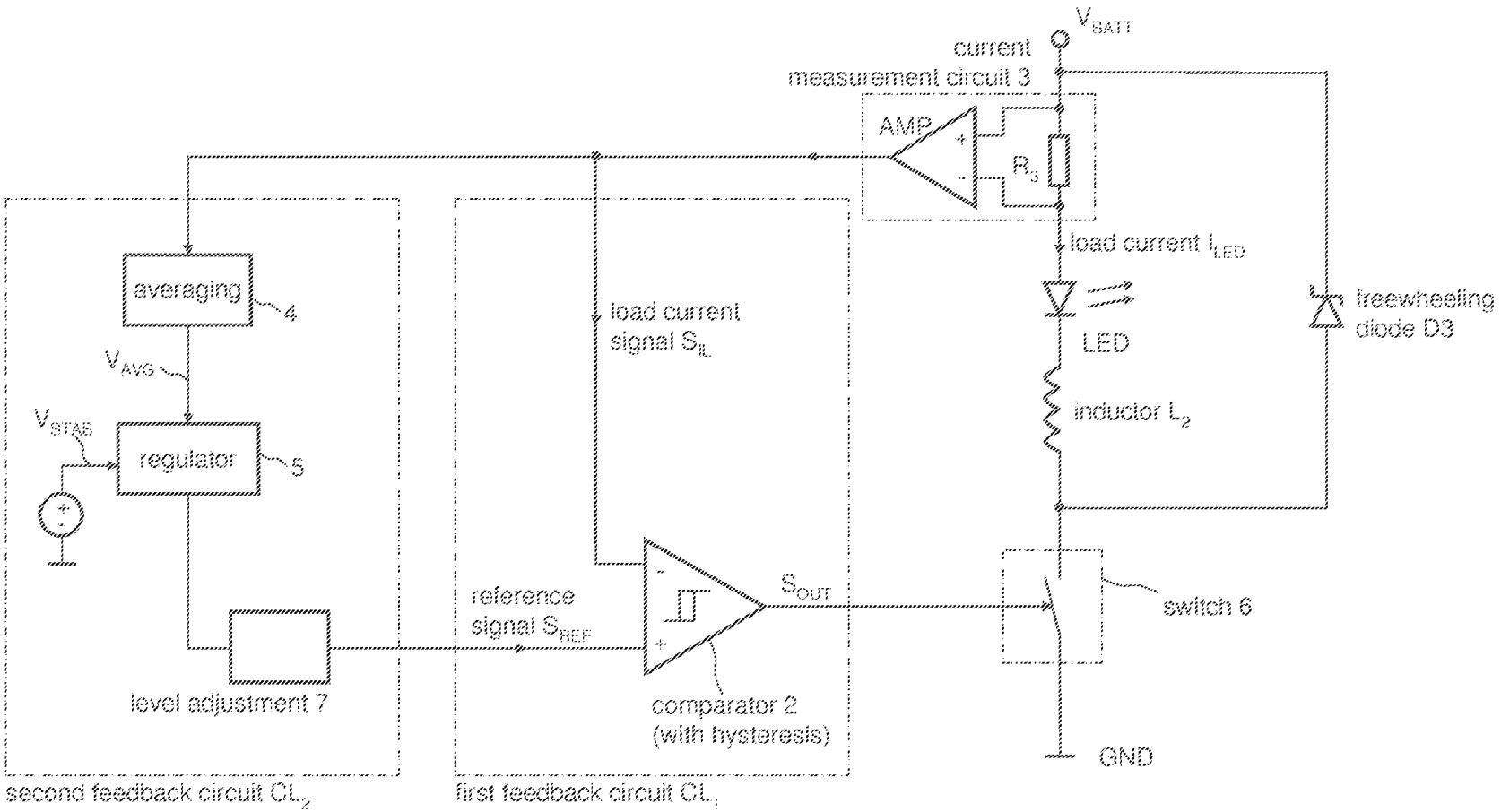

FIG. 5*c* essentially illustrates the same LED driver circuit as shown in FIG. 5*a*. However, the second feedback circuit $CL_2$ and the current measurement circuit 3 are illustrated in more detail. Similar to the previous examples, the low-side switch 6 is connected in series to the inductor $L_2$ and the LED, which may be replaced by a LED chain. The series circuit of switch 6, LED, and inductor $L_2$ is coupled between a first supply terminal (supply voltage $V_{BATT}$) and a second supply terminal (e.g., ground GND). The order of inductor $L_2$ and LED may be interchanged. The current measurement circuit 3 includes a shunt resistor $R_3$, which is coupled in series to the LED such that the load current $i_{LED}$ also passes the shunt resistor and the voltage drop $R_3 \cdot I_{LED}$ across the shunt resistor $R_3$ is proportional to the load current $I_{LED}$ (or the inductor current $I_L=I_{LED}$). The voltage drop $R_3 \cdot I_{LED}$ across the shunt resistor $R_3$ may be supplied to an amplifier AMP which amplifies the voltage drop and generates a respective load current signal $S_{IL}$, which represents the load current $i_L$. The amplifier AMP may be, e.g., a simple differential amplifier, an operational amplifier, a transconductance amplifier or any other appropriate amplifying circuit. The current signal $S_{IL}$ may be a voltage signal or, alternatively, a current signal dependent on the actual implementation. The semiconductor switch 6 can be switched on and off by applying an appropriate driver signal $S_{our}$ to a respective control signal of the switch 6 (e.g., a gate signal when using a MOSFET as a power semiconductor switch).

The first feedback circuit receives, as input signal, the load current signal $S_{IL}$ as well as the reference signal $S_{REF}$, which can be regarded as a set point value for the on-off controller which is implemented by the comparator 2 as mentioned above. The comparator 2 receives the reference signal $S_{REF}$ and the load current signal $S_{IL}$, and generates an output signal $S_{OUT}$ for driving the power semiconductor switch 6 as explained above with reference to FIG. 5*a*. The operation of the first feedback circuit $CL_1$ is entirely the same as in the example of FIG. 5*a* and is therefore not repeated here. The waveform of the load current $i_{LED}$ and the switching operation of the switch 6 correspond to the timing diagrams illustrated in FIG. 4.

To maintain the actual average $I_{AVG}$ of the load current $I_{LED}$ at a constant level while the supply voltage $V_{BATT}$ (or the temperature-dependent forward voltage of the LED) changes, the second feedback circuit $CL_2$ regulates the reference signal $S_{REF}$ and thus the set point value for the first feedback circuit $CL_1$. As mentioned above, the control law implemented by the second feedback circuit $CL_2$ ensures that the reference signal $S_{REF}$ is generated dependent on the difference between an average load current value $I_{AVG}$ and a pre-set constant value. For this purpose, the second feedback circuit $CL_2$ includes a filter 4 circuit which receives, as input signal, the load current signal $S_{IL}$, and provides, as output signal, a filtered signal $V_{AVG}$ which can be regarded as a signal representing the (e.g., moving) average load current $I_{AVG}$. The filter may be, for example, a passive RC filter composed of a resistor and a capacitor. Alternatively, the load current signal $S_{IL}$, may be digitized using any suitable analog-to-digital converter. In this case, the filter 4 may be implemented as a digital filter using a digital signal processor and appropriate software. Not only the filter 4, but the whole second feedback circuit $CL_2$ (and even parts of the first feedback circuit $CL_1$) may be digitally implemented using an appropriately programmed signal processor. In this case the entities here referred to as circuits can be seen as software-implemented functional units.

The filter output signal $V_{AVG}$ (that represents the average load current $I_{AVG}$) as well as a stabilized reference value (e.g., a stabilized reference voltage or, in digital implementations, a register value) are supplied to the regulator 5. The regulator 5 may be, in a simple example, a P-controller. However, the regulator 5 may be also be a PI-, PID-, or PT1-controller or something similar. Generally, the controller 5 may be configured to minimize or at least reduce any offset $V_{STAB}-V_{AVG}$ between average load current (represented by signal $V_{AVG}$) and the reference value $V_{STAB}$. Regulators having an I-component such as a PI-controller may achieve a steady state control offset of zero.

Figure 9:
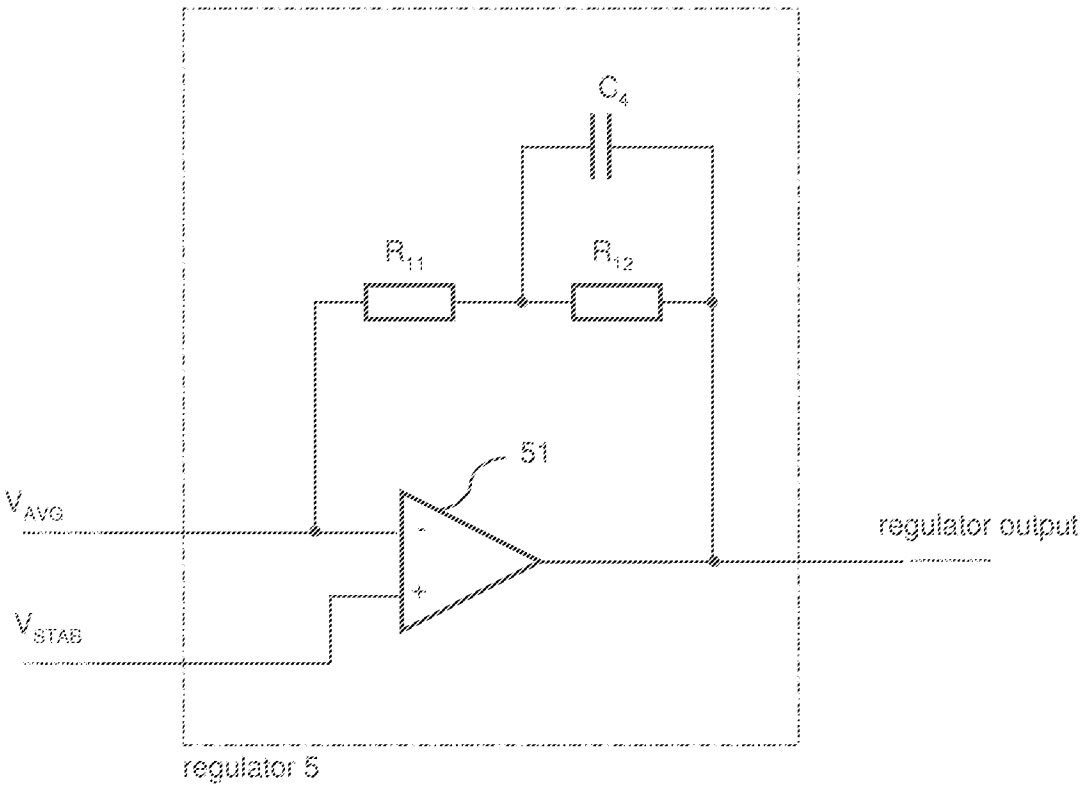
FIG. 9 illustrates one example of a controller that may be used in the LED driver circuits described herein.

The regulator 5 may include an operational amplifier 51. Depending on the type (P, PI, PIC, PT1, etc.) of regulator 5 that is used, different components are needed to set up the regulator 5. In case of a PT1-controller, for example, the operational amplifier 51 receives the reference value $V_{STAB}$ at its inverting input terminal. A first resistor $R_{11}$ and a parallel circuit of a second resistor $R_{12}$ and a capacitor $C_4$ are coupled in series between the inverting input terminal and the output terminal of the operational amplifier 51. An example of such a regulator 5 is shown in FIG. 9. In some exemplary embodiments it may be advantageous to use a PT1-controller. However, in other examples other types of controllers 5 may be used. In such cases, other components in different configurations are needed to implement the respective controller types.

The offset $V_{STAB}-V_{AVG}$ may be amplified and modified within the regulator 5 and the regulator output signal may either directly supplied to the first feedback circuit $CL_1$ as reference signal $S_{REF}$ or further modified by a level adjusting circuit 7 before being supplied to the first feedback circuit $CL_1$. The circuit 7 may be configured to modify reference signal $S_{REF}$, which is the set point value for the first feedback circuit $CL_1$, i.e., for the on-off controller 2. The optional circuit 7 may simply perform a kind of level shift. Additionally, or alternatively, the circuit 7 may regularly blank the reference signal $S_{REF}$ (i.e., set the reference signal $S_{REF}$ to zero for a certain time period) in order to provide a dimming function. Examples of the circuit 7 and the dimming capabilities of the present LED driver are discussed later.

Figure 6:
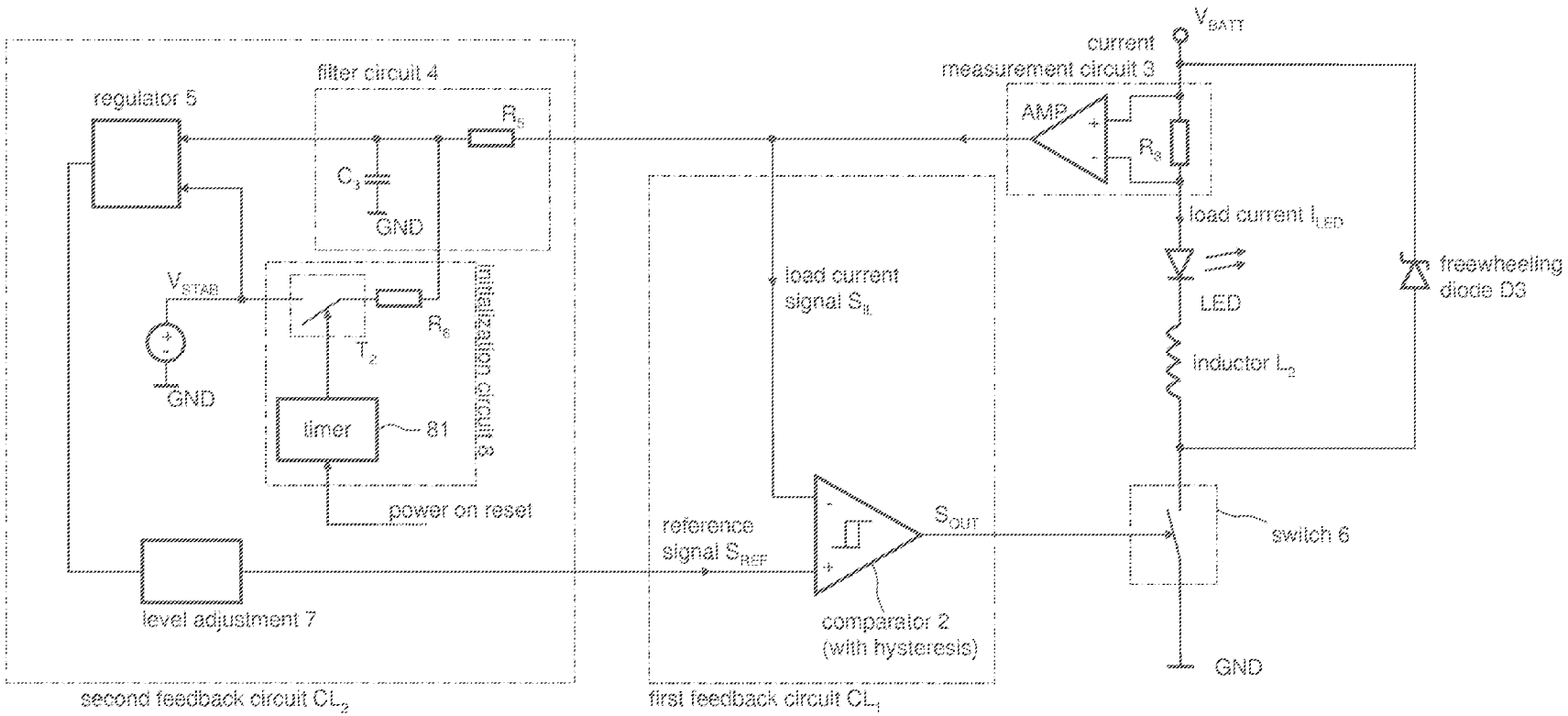
FIG. 6 illustrates another exemplary LED driver circuit with an improved power-on behaviour.

FIG. 6 illustrates another exemplary circuit for maintaining the average load current $I_{AVG}$ at a desired level independent from the supply voltage $V_{BATT}$. The circuit generally corresponds to the circuits shown in FIGS. 5*a* and 5*c*. The filter 4 (averaging circuit), however, is illustrated in more detail. The filter 4 may include, e.g., a passive first order RC low pass filter, which is formed by a resistor $R_5$ and a capacitor $C_3$. Other filter types (e.g., higher order filters, digital filter) may also be applicable.

To avoid undesired transient effects during start-up (after powering on the circuit) an initialization circuit 8 may be used to set the filter output of the filter 4 to an initial value at or close to the desired value given by the stabilized reference value $V_{STAB}$. In the simple (and thus very cost-efficient and suitable for low-cost applications) implementation implemented in the example of FIG. 6, the initialization circuit 8 quickly pre-charges the capacitor $C_3$, which is connected to the filter output, directly after powering on the LED driver circuit. This may be accomplished by temporarily connecting the stabilized reference voltage $V_{STAB}$ to the capacitor via a semiconductor switch $T_2$. The switch $T_2$ may be closed for a defined (e.g., fixed) time period. Closing and reopening the switch may be controlled using a timer circuit 81, which may be, for example, a timer circuit (e.g., a monoflop) which generates a pulse of a defined length in response to a power-on signal.

In the example depicted in FIG. 6 a first terminal of the semiconductor switch $T_2$ (e.g., a MOSFET or a BJT) is connected to the common circuit node between the resistor $R_5$ and the capacitor $C_3$ via a further resistor $R_6$ (optional). A second terminal of the semiconductor switch $T_2$ is coupled to the voltage source providing the stabilized voltage value $V_{STAB}$. However, any other voltage value may be also used as an initial value, e.g., 90 percent of $V_{STAB}$. A control input (in case of a MOSFET; the gate, in case of a BJT; the base terminal) of the switch $T_2$ is connected to timer circuit 81 mentioned above. If the timer unit is implemented as a monoflop, then it maintains a defined voltage at the capacitance $C_3$ for a certain time, thus initializing the filter output to a desired initial value. The time delay unit 81 may be triggered by a power-on reset signal, for example. This power-on reset signal may be available once, at power-on of the system.

Figure 7:
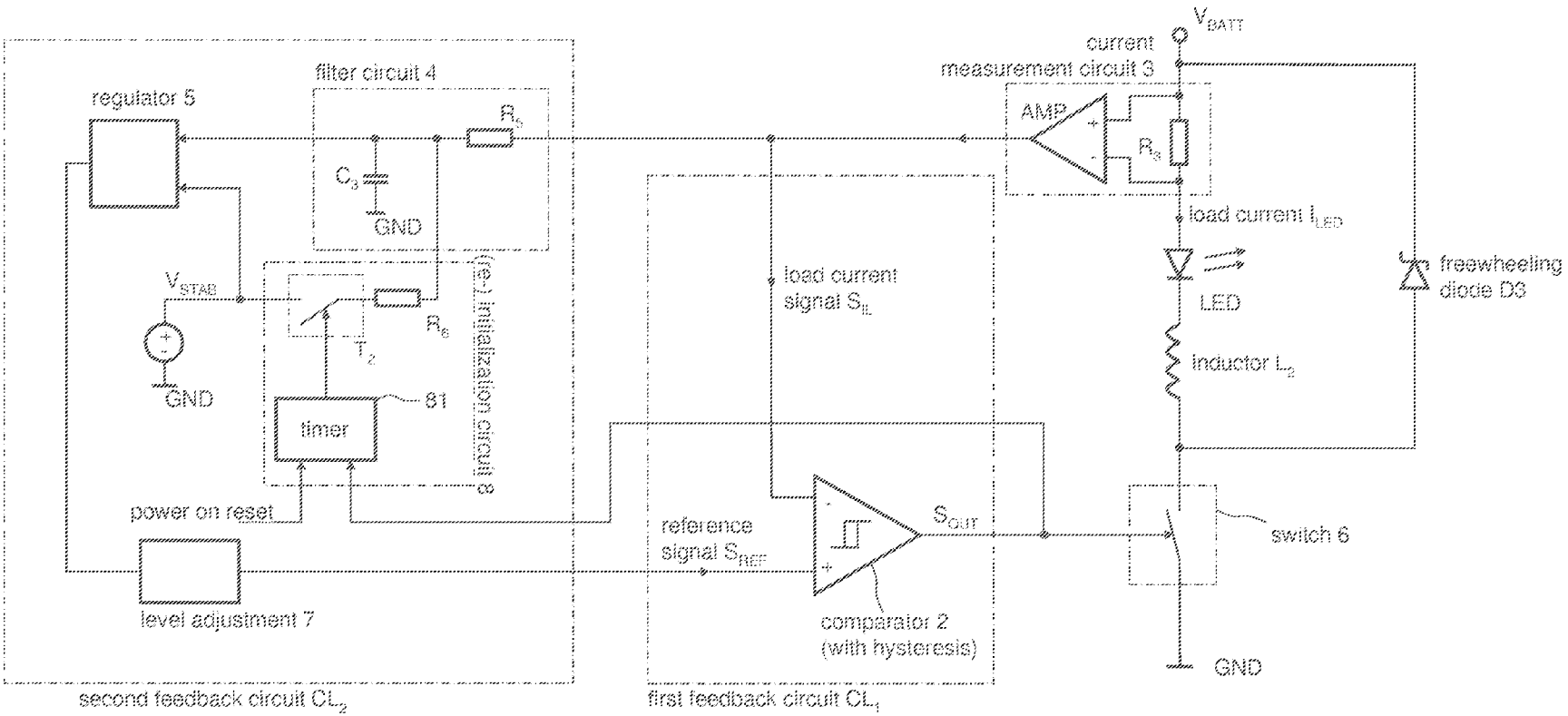
FIG. 7 illustrates another exemplary LED driver circuit similar to the example of FIG. 6.

The example illustrated in FIG. 7 is very similar to the previous example of FIG. 6. The only difference is the implementation of the timer circuit 81. In the present example, the timer circuit 81 is also responsive to the driver signal $S_{OUT}$ that triggers the activation and deactivation of the power semiconductor switch 6. In the present example the timer circuit triggers a re-initialization (e.g., by activating the switch $T_2$ for a fixed time period) in response to a switch-on of the power semiconductor switch 6, but only when the switch 6 has been off for a defined time. That is, a re-initialization is not triggered during the "normal" switching operation of switch 6. However, when the switching operation of the power semiconductor switch 6 is temporarily paused (e.g., for dimming purposes, see description of FIG. 10) for a defined minimum time, a re-initialization is triggered when the normal switching operation of switch 6 resumes.

The LED driver circuits depicted in FIGS. 6 and 7 are configured to clamp the voltage across the capacitor $C_3$ of the filter 4—and thus the filter output signal $V_{AVG}$—to a value corresponding to the stabilized reference value $V_{STAB}$. Generally, such a function is not necessary for a circuit driving LEDs, but may, however, be useful during start-up of the circuit and during a dimming operation, during which the load current is repeatedly switched on and off in accordance to a pre-defined modulation scheme (e.g., pulse-width modulation, sigma-delta modulation or the like).

Figure 8:
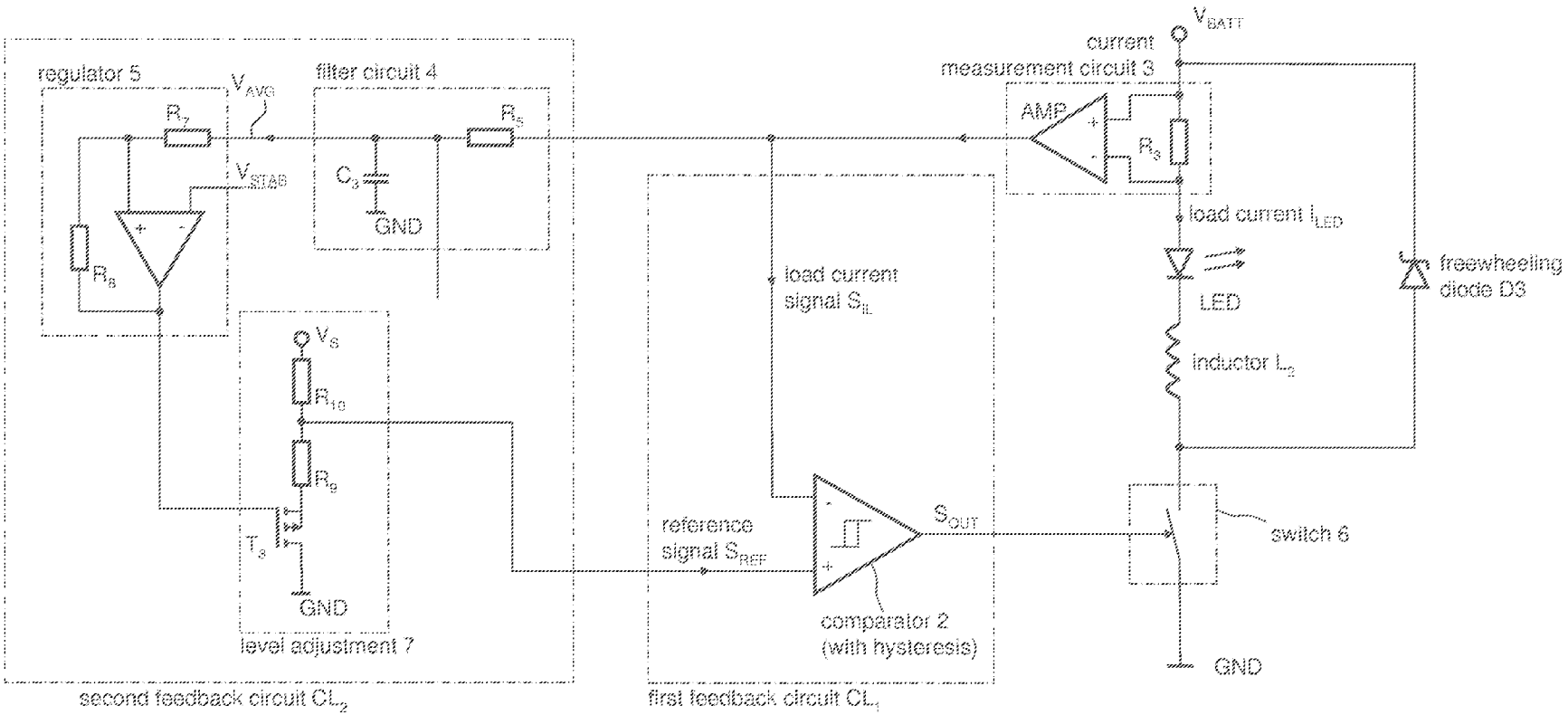
FIG. 8 illustrates the LED driver circuit of FIG. 5*c* in more detail.

In FIG. 8, another exemplary LED driver circuit is shown in more detail. As in the previous examples, the filter 4 is a passive RC filter including the resistor $R_5$ and the capacitor $C_3$. The regulator 5 includes an operational amplifier 51. At its inverting input terminal, the operational amplifier 51 receives the stabilized reference voltage value $V_{STAB}$. A resistor $R_7$ is coupled between the non-inverting input terminal of the operational amplifier 51 and the input terminal of the regulator 5, with which it is coupled to the filter 4. A further resistor $R_8$ is coupled between the non-inverting input terminal and the output terminal of the operational amplifier 51.

In the present example, the level adjusting circuit 7 operates similar to a level shifter. It includes a transistor $T_3$. The transistor $T_3$ is coupled to the output terminal of the regulator 5. The load current path of transistor $T_3$ is connected between the reference potential GND and a resistor $R_9$. A further resistor $R_{10}$ is coupled between the resistor $R_9$ and a terminal for a positive potential $V_S$. The reference signal $S_{REF}$ supplied to the first feedback circuit is tapped at the common circuit node between the two resistors $R_9$ and $R_{10}$.

Figure 10:
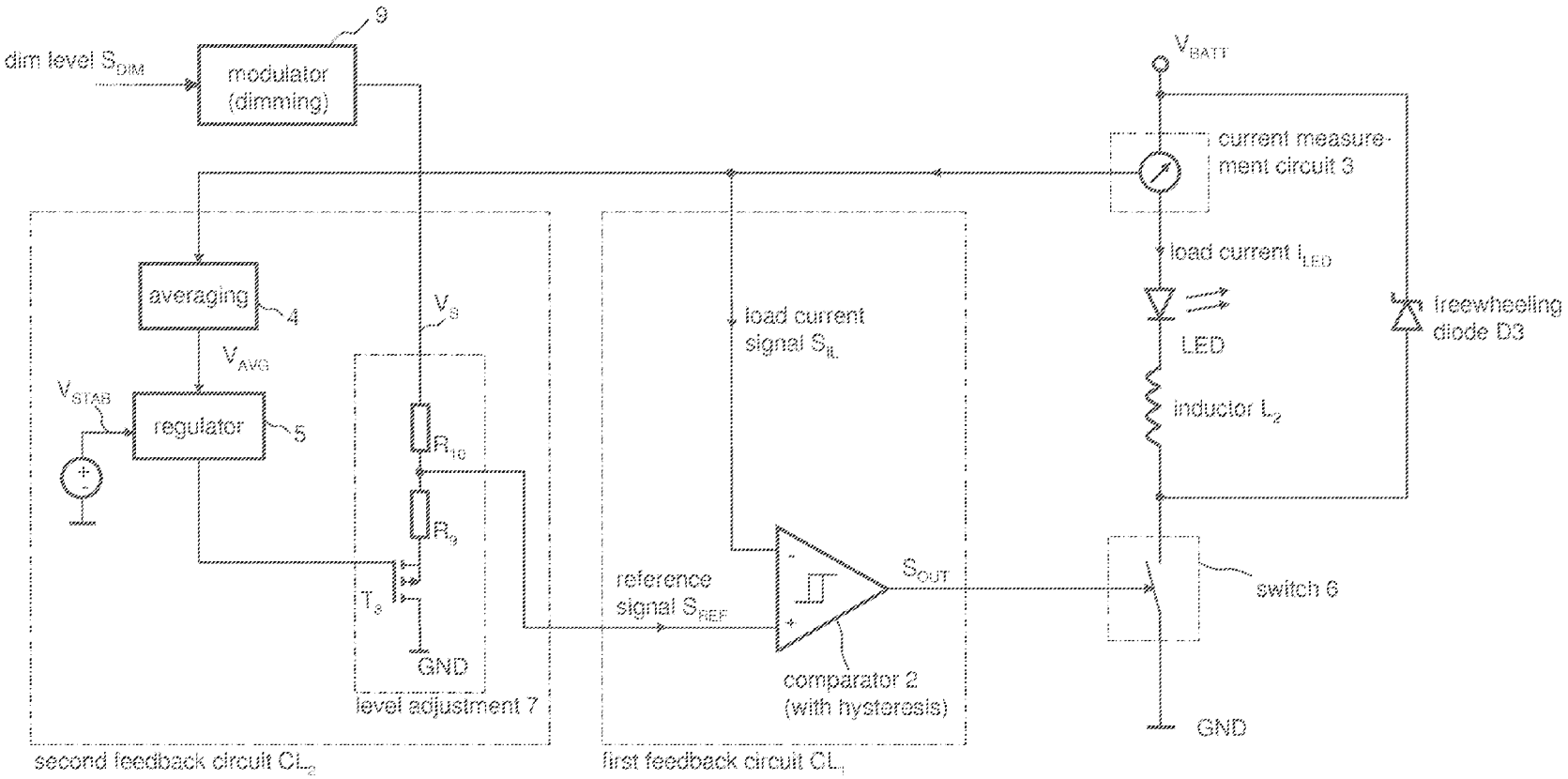
FIG. 10 illustrates another exemplary LED driver circuit including a dimming function.

The example FIG. 10 illustrates a LED driver circuit similar to the circuit of FIG. 5*c*. However, the present example additionally includes a dimming capability. For this purpose, the level adjusting circuit 7 may implemented the same way as in the example shown in FIG. 8. As discussed with reference to FIG. 8, the level adjustment circuit 7 subjects the reference signal $S_{REF}'$, generated by the regulator 5 (i.e., the control signal), to a level shift in accordance with a defined characteristic curve, which, in the present example, is dependent on the characteristics of the transistor $T_3$ and the resistors $R_{10}$ and $R_9$. The level adjustment circuit 7 as illustrated in the present example may be regarded as a controllable voltage divider which divides an input voltage $V_S$ (which is constant in the example of FIG. 8 and on/off-modulated in the present example) into a fractional voltage $V_S \cdot (R_9+R_{ON})/(R_9+R_{10}+R_{ON})$, wherein $R_{ON}$ is the on-resistance of the transistor $T_3$ and thus a function of the reference voltage $S_{REF}'$ provided by the regulator 5 and supplied to the control terminal (i.e., the gate terminal in case of a MOSFET) of the transistor. The middle tap of the voltage divider is the output circuit node of the level adjustment circuit 7 at which the "level adjusted" reference signal $S_{REF}$ is provided, which is a bijective function of the control signal $S_{REF}'$ (i.e., a one-to-one correspondence) provided by the regulator 5. The function depends on the characteristic curves and the resistance values of the resistors $R_9$ and $R_{10}$.

Generally, the function provided by the circuit 7 is adjusting the level of the control signal $S_{REF}'$ provided by the regulator 7 in accordance with a characteristic curve. The controllable voltage divider shown in FIG. 10 has to be regarded as one simple example. A skilled person will have no difficulties achieving the same or a similar function using a difference circuitry (e.g., amplifier circuits or the like). In a digital implementation the characteristic curve may be defined by parameters stored in a memory or by interpolation in a look-up table. However, for low-cost applications a digital solution might be too complex and expensive.

Dimming capability may easily implemented by on/off-modulating the input voltage $V_S$ supplied to the level adjustment circuit 7 in accordance with desired duty cycle (usually expressed as a percentage). For example, a duty cycle of 30 percent entails that the reference signal $S_{REF}$ is off (e.g., at ground potential, 0V), on average, for 70 percent of the time. For this purpose a modulator 8 is provided that generates the input signal $V_S$ for the level adjustment circuit. Any kind of modulation may be applicable, such as pulse width modulation, pulse frequency modulation, sigma-delta modulation (also referred to as pulse density modulation), various random modulation schemes, etc. It should be noted that the modulation of the reference signal $S_{REF}$ may also be accomplished in a manner different from the example illustrated in FIG. 7. A skilled person will have no difficulties achieving the same or a similar function using different circuitry. For example the comparator input receiving the reference signal $S_{REF}$ may be tied to ground potential using a switch that is activated and deactivated in accordance with a modulated signal (e.g., provided by the modulator 8) and in which the input signal $V_S$ is constant.

It should be noted that the filter initialization shown in the example of FIG. 7 may be usefully applied in the present example. Compared to the switching frequency of the power semiconductor switch 6 (e.g., in the hundred kilohertz range) the modulation frequency of the modulator 8 is usually much smaller (e.g., up to 10 kilohertz). That is, when dimming is active the off-phase may be comparably long and, as a consequence, the average load current signal $V_{AVG}$ provided by the filter 4 drops. The value of interest provided by the filter is, however, the average load current during the on-phase of the load current. To avoid transient effects such as those seen during a power-on phase of the circuit, the filter output is initialized to a value close to the desired average load current signal level $V_{AVG}$ every time the switch 6 is switched on after being off for a "longer" period (i.e., longer than the off-period during "normal" switching operation when the reference signal $S_{REF}$ is not blanked by the modulator 8). For this purpose the initialization unit 81 (see FIG. 7) ignores rising edges occurring in the driver signal $S_{OUT}$ unless it has been low for a given minimum off-time. This minimum off time may be chosen to fit to the time constant of the filter 4.

Figure 11:
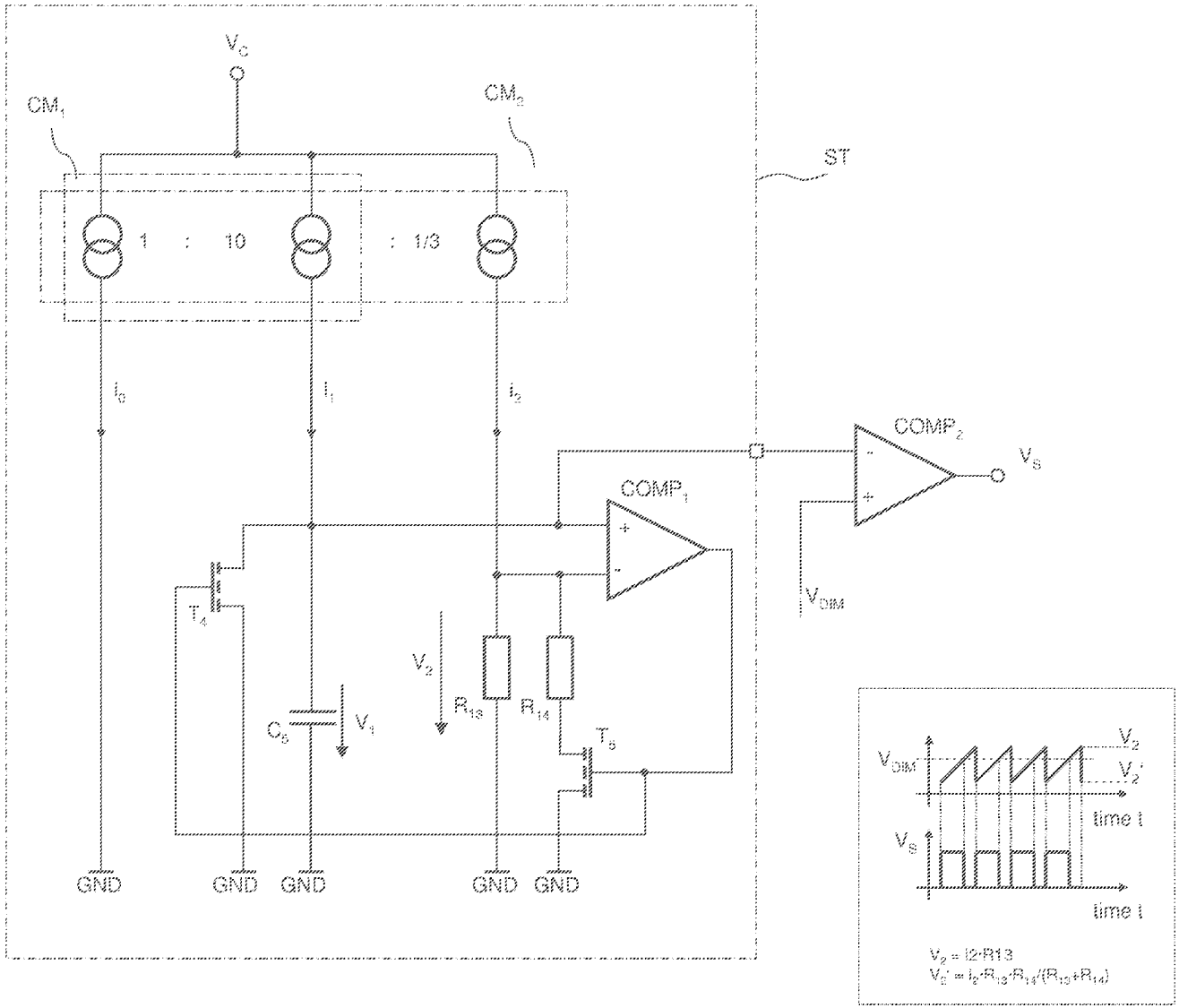
FIG. 11 illustrates one exemplary implementation of the modulator used in the example of FIG. 10.

In FIG. 11 a pulse width modulation generator, which may be used as modulator 8 in connection with the example illustrated in FIG. 10, is illustrated. In known LED drivers, the reference voltage supplied to the comparator 2 (see, e.g., FIG. 5*a*) can be altered in order to dim the LED current $I_{LED}$. This method, however, is often imprecise and temperature dependent.

The PWM-modulator circuit shown in FIG. 11 includes a sawtooth generator ST and a comparator $COMP_2$. The sawtooth generator ST includes a first current minor $CM_1$, a second current minor $CM_2$ and a comparator $COMP_1$. A capacitor $C_5$ is coupled between the non-inverting input terminal and the output terminal of the comparator $COMP_1$. Further, the capacitor $C_5$ is coupled to the first current mirror $CM_1$ such that it is charged with a constant current $i_1$, which is proportional (in the present example $i_1=i_0/10$) to the current mirror constant input current $i_0$. A transistor $T_4$ is coupled between the non-inverting comparator input of comparator $COMP_1$ and a terminal for reference potential GND. The control terminal (e.g., the gate) of the transistor $T_4$ is coupled to the output of the comparator $COMP_1$. Thus, the capacitor $C_5$ is discharged via the transistor $T_4$ when the comparator output switches to a high level.

A resistor $R_{13}$ is coupled between the second current mirror $CM_2$ and the terminal for reference potential GND. The inverting input terminal of the comparator $COMP_1$ is connected to the common circuit node of the current mirror $CM_2$ and the resistor $R_{13}$. A series circuit of a further resistor $R_{14}$ and a further transistor $T_5$ is coupled in parallel to the resistor $R_{13}$. The transistor $T_5$ switches on and off in accordance with the comparator output signal of comparator $COMP_1$. While the transistor $T_5$ is off the constant current $i_2$ (in the present example $i_2=i_0 \cdot 3$) provided by the second current mirror $CM_2$ passes through the resistor $R_{13}$, thereby creating a voltage drop $V_2=i_2 \cdot R_{13}$ across the resistor $R_{13}$. Thus, the comparator $COMP_1$ switches from a low level to a high level when the (linearly rising) voltage $V_1$ across the capacitor reaches the threshold voltage $V_2$. The non-inverting input terminal of the comparator $COMP_1$ provides the output-signal (sawtooth signal) of the sawtooth-generator, which corresponds to the voltage $V_1$ across the capacitor $C_5$.

An externally supplied analogue voltage is transformed into a corresponding PWM-signal $V_S$ by means of this second comparator $COMP_2$. A constant current $i_0$ is converted into a current $i_1$ by means of the first current mirror $CM_1$. This may be a high-side pMOS current mirror, for example. The reference current $i_0$ may be 10 μA, for example. If a 1:10 current mirror is used, the current value of $i_1$ is about 1 μA. The second current mirror $CM_2$ generates a second current $i_2$. The second current mirror $CM_2$ may generate a current $i_2$, which is three times higher than the constant current $i_0$ ($i_2$=30 μA), for example. This current $i_2$ then passes through the resistor $R_{13}$ thereby creating a voltage $V_2$ across the resistor.

Both transistors $T_4$, $T_5$ are not conducting (off) when the comparator output of the comparator $COMP_1$ is low. The capacitance $C_5$ is charged by the current $i_1$ during this time period. When a voltage $V_1$ across the capacitance $C_5$ exceeds the voltage $V_2$, the comparator $COMP_1$ becomes active and switches the two transistors $T_4$, $T_5$ on. The transistor $T_4$ discharges the capacitance $C_5$ abruptly to the value of $V_2$ ($V_2=i_2 \cdot R_{13} \cdot R_{14} \cdot (R_{13}+R_{14})$), as the transistor $T_5$ connects the resistance $R_{14}$ in parallel to the resistance $R_{13}$. The voltage $V_2$ reduces faster than the voltage $V_1$, because the capacitance $C_5$ has to be discharged via the on-resistance of the transistor $T_4$. The switch-off time may be defined by the length to width ratio of the transistor T4.

When the capacitor voltage $V_1$ falls below the voltage $V_2$, the output signal of the comparator $COMP_1$ returns to a low-level and the transistors $T_4$, $T_5$ become non-conductive again. As a result, a voltage $V_2=i_2 \cdot R_{13}$ is supplied again at the inverting input terminal of the comparator $COMP_1$ and the charging of the capacitance $C_5$ starts again.

Within this circuit, it is possible to set the upper threshold value by means of the resistor $R_{13}$ and the lower threshold value by means of the resistor $R_{14}$ (coupled in parallel to the resistor $R_{13}$).

The further comparator $COMP_2$ receives output voltage of the sawtooth generator ST, at a first input terminal and compares it to a dimming signal $S_{DIM}$ (i.e., the reference voltage $V_{DIM}$ in the present example) which is supplied to the second input terminal. The comparator output switches when the sawtooth voltage reaches the reference voltage $V_{DIM}$. The duty cycle of the PWM signal is proportional to the reference voltage $V_{DIM}$. Alternatively, the reference signal $S_{DIM}$ may be an on-off modulated signal having an on-level higher than the peak level of the saw-tooth signal. In this case, the dimming signal $S_{DIM}$ is forwarded to the output of comparator $COMP_2$.

Although exemplary embodiments and its advantages have been described in detail, it should be understood that various changes, substitutions and alterations can be made herein without departing from the spirit and the scope of the invention as defined by the appended claims. With the above range of variations and applications in mind, it should be understood that the present invention is not limited by the foregoing description, nor is it limited by the accompanying drawings. Instead, the present invention is limited only by the following claims and their legal equivalents.

Spatially relative terms such as "under," "below," "lower," "over," "upper" and the like are used for ease of description to explain the positioning of one element relative to a second element. These terms are intended to encompass different orientations of the device in addition to orientations different than those depicted in the figures. Further, terms such as "first," "second" and the like, are also used to describe various elements, regions, sections, etc. and are also not intended to be limiting. Like terms refer to like elements throughout the description.

As used herein, the terms "having," "containing," "including," "comprising" and the like are open ended terms that indicate the presence of stated elements or features, but do not preclude additional elements or features. The articles "a," "an" and "the" are intended to include the plural as well as the singular, unless the context clearly indicates otherwise.

What is claimed is:

1. A circuit for driving light emitting diodes, the circuit comprising:

a first semiconductor switch and a freewheeling device coupled between a first supply terminal that provides a supply voltage and a second supply terminal that provides a reference potential, the first semiconductor switch being responsive to a driver signal;

an LED and an inductor coupled in series between a common circuit node of the first semiconductor switch and the freewheeling device and either the first supply terminal or the second supply terminal;

a current measurement circuit coupled to the LED, the current measurement circuit configured to provide a load current signal that represents a load current passing through the LED;

a first feedback circuit including an on-off controller that is configured to receive the load current signal and a reference signal, to compare the load current signal with the reference signal, and to generate the driver signal dependent on the comparison; and a second feedback circuit configured to receive the load current signal, to determine an average load current signal, and to generate the reference signal supplied to the first feedback circuit dependent on the average load current signal and a reference value.

2. The circuit of claim 1, wherein the second feedback circuit comprises:

a filter coupled to receive the load current signal and to provide a filtered signal representing the average load current; and a regulator coupled to receive the filtered signal and the reference value as set point value, the regulator configured to determine a control signal dependent on a difference between the reference value and the filtered signal in accordance with a predefined control law, and to generate the reference signal in accordance with the control signal.

3. The circuit of claim 2, further comprising a level adjusting circuit configured to receive the control signal, to subject the control signal to a level adjustment dependent on an input signal, and to provide the reference signal.

4. The circuit of claim 3, wherein the level adjusting circuit comprises an amplifier.

5. The circuit of claim 3, wherein the level adjusting circuit comprises a voltage divider having a controllable division ratio, the voltage divider coupled to receive an input voltage and to provide a fraction of the input voltage to the first feedback circuit as reference signal, the controllable ratio being responsive to the control signal provided by the regulator.

6. The circuit of claim 3, wherein the input signal is either constant or modulated between zero and peak level.

7. The circuit of claim 3, further comprising a modulator that is supplied with a dim level, and is configured to provide, as the input signal to the level adjusting circuit, a modulated signal having either a zero level or a defined peak level in accordance with a duty cycle.

8. The circuit of claim 2, wherein the second feedback circuit further comprises an initialization circuit that is configured to initialize an output of the filter to an initial value at or close to the reference value in response to at least one of the following events: a power-on of the circuit or an activation of the first semiconductor switch after being deactivated for a defined minimum time.

9. The circuit of claim 8, wherein the initialization circuit comprises a timer circuit and a further switch coupled to the filter; and wherein the switch, while activated by the timer circuit for a defined time period, connects an output of the filter to an initialization voltage having a voltage level at or close to the reference value, thus initializing the filtered signal to the voltage level.

10. An LED driver for driving an LED that is coupled in series with an inductor between a driver output terminal and a first or a second supply terminal, the first supply terminal to carry a supply voltage and the second supply terminal to carry a reference potential, the LED driver comprising:

a first semiconductor switch and a freewheeling device coupled between the first supply terminal and the second supply terminal, the first semiconductor switch being responsive to a driver signal and a common circuit node between the first semiconductor switch and the freewheeling device being connected to the output terminal;

a current measurement circuit to be coupled to the LED and to provide a load current signal that represents a load current passing through the LED;

a first feedback circuit including an on/off controller coupled to receive the load current signal and a reference signal, the on/off controller configured to compare the load current signal with the reference signal, and to generate the driver signal dependent on the comparison;

a second feedback circuit that comprises a filter and a regulator, wherein the filter is coupled to receive the load current signal and to provide a filtered signal that represents an average load current; and wherein the regulator is coupled to receive the filtered signal and a reference value as a set point value, the regulator configured to determine a control signal dependent on a difference between the reference value and the filtered signal in accordance with a predefined control law, and to generate the reference signal in accordance with the control signal.

11. A method for driving an LED that is coupled in series to an inductor between an output terminal and a first or a second supply terminal, the first supply terminal to carry a supply voltage and the second supply terminal to carry a reference potential; the method comprises:

measuring a load current passing through the LED, thus generating a load current signal that represents the load current;

alternately applying either the supply voltage or the reference potential to the output terminal in accordance with a driver signal;

comparing the load current signal with a reference signal and generating the driver signal dependent on the comparison;

determining an average load current signal from the load current signal; and generating the reference signal dependent on the average load current signal and a reference value.

12. The method of claim 11, wherein determining the average load current signal comprises:

filtering the load current signal; and providing a filtered signal as average load current signal.

13. The method of claim 12, wherein determining the average load current signal further comprises:

initializing the filtered signal to a signal value at or close to the reference value in response to at least one of the following events: detection of a power-on signal, or detection that the supply voltage is applied to the output terminal after the reference potential has been applied to the output terminal for more than a defined minimum time.

14. The method of claim 12, wherein generating the reference signal comprises:

determining a difference between the filtered signal and the reference value;

generating a control signal dependent on the difference in accordance with a pre-defined control law; and adjusting the level of the control signal to provide the reference signal.

15. The method of claim 11, wherein generating the reference signal comprises:

blanking the reference signal in accordance to an on/off-modulated signal having a duty cycle.

* * * * *